United States Patent [19]

Simmons et al.

[11] 4,296,509

[45] Oct. 27, 1981

[54] PORTABLE INVALID LIFT

[76] Inventors: Dwane P. Simmons, 7465 Olive Tree La., Highland, Calif. 92346; Ray E. Lynn, 5172 Acacia St., San Bernardino, Calif. 92407

[21] Appl. No.: 87,343

[22] Filed: Oct. 23, 1979

[51] Int. Cl.[3] ..... A61G 7/08

[52] U.S. Cl. ..... 5/81 R; 248/168

[58] Field of Search ..... 248/168, 169, 170, 171; 182/179, 185; 5/81 R, 83–86; 414/462, 542; 212/134

[56] References Cited

U.S. PATENT DOCUMENTS

| | | | |
|---|---|---|---|
| 462,581 | 11/1891 | Peck | 182/185 |
| 508,866 | 11/1893 | Butcher | 212/134 X |
| 635,038 | 10/1899 | Ely . | |
| 1,116,272 | 11/1914 | Haselton | 212/134 UX |
| 1,234,510 | 7/1917 | Trautwein | 248/170 UX |
| 1,456,356 | 5/1923 | Bentley | 248/169 X |
| 1,580,283 | 4/1926 | Brown . | |
| 1,631,279 | 6/1927 | Mandy . | |
| 1,738,758 | 12/1929 | Cottman | 5/86 |
| 1,878,785 | 9/1932 | Leavitt | 5/86 |
| 1,971,294 | 8/1934 | Bunker | 5/89 |
| 2,023,790 | 12/1935 | Ormsby et al. | 414/542 |
| 2,035,116 | 3/1936 | Elmick | 5/89 |
| 2,208,491 | 7/1940 | Bailey | 212/134 |
| 2,465,289 | 3/1949 | Sitton | 248/168 |
| 2,516,553 | 7/1950 | Cole | 5/86 |
| 2,659,092 | 11/1953 | Conyers | 5/86 |
| 2,680,855 | 6/1954 | Robinson | 5/83 |
| 2,706,120 | 4/1955 | Stratton | 280/35 |
| 2,739,783 | 3/1956 | Pentecost | 5/86 |
| 2,821,406 | 1/1958 | Hoyer et al. | 5/89 |
| 3,082,027 | 3/1963 | Johnson | 182/185 |
| 3,207,206 | 9/1965 | Braddon et al. | 248/168 |
| 3,351,959 | 11/1967 | Turpin | 5/83 |
| 3,469,269 | 9/1969 | Brown | 5/86 |
| 3,520,514 | 7/1970 | Evans | 248/168 X |
| 3,568,226 | 3/1971 | Matu | 5/86 |
| 3,656,637 | 4/1972 | Lyn et al. | 414/542 |
| 3,694,829 | 10/1972 | Bakker | 5/81 R |
| 3,711,877 | 1/1973 | Avenill | 5/81 R |
| 3,829,916 | 8/1974 | James | 5/86 |
| 3,877,089 | 4/1975 | Spivey et al. | 5/86 |
| 3,877,421 | 4/1975 | Brown | 5/81 B |
| 3,940,808 | 3/1976 | Petrini | 5/86 |
| 3,962,737 | 6/1976 | James | 5/86 |
| 3,983,584 | 10/1976 | Holecek | 5/81 R |
| 4,075,719 | 2/1978 | Sullivan | 5/81 R |
| 4,141,094 | 2/1979 | Ferguson et al. | 5/81 R |
| 4,144,713 | 3/1979 | Clark et al. | 5/81 R |
| 4,156,946 | 6/1979 | Attenburrow | 5/81 R |
| 4,157,593 | 6/1979 | Kristenson | 5/81 R |

OTHER PUBLICATIONS

Self-lift, Holo Ind., Garden Grove, Calif.

Travel-lifter, Mfg. Ted Hoyer & Co., Inc., Oshkosh, Wis.

*Primary Examiner*—J. Franklin Foss

[57] ABSTRACT

A portable apparatus to enable a wheel chair invalid to be transferred onto and out of a bed or chair, comprising an overhead track extending over the bed or chair supported by a tripod with telescoping legs at each end, and a wheeled carriage that rides on the track. The wheeled carriage is equipped with a winch and rope tackle that hooks onto a flexible fabric sling in which the invalid sits. Activating the winch raises the sling clear of the wheel chair and the wheeled carriage is moved over the bed or chair. The sling is then lowered to the bed or chair and disconnected from the tackle. The apparatus can be broken down in sections, the tripod legs telescoped and folded, and all parts placed in an automobile trunk for transport or storage in a small space.

1 Claim, 5 Drawing Figures

PORTABLE INVALID LIFT

BACKGROUND OF THE INVENTION

This invention relates to apparatus for transferring wheel chair invalids onto and out of a bed or chair, and more particularly to a device that can be broken down and transported in an automobile interior or trunk, or stored in a small space.

Paraplegics, quadriplegics, amputees, and others without the use of arms and legs have great difficulty in transferring from wheel chain to bed or chair and back. There has long been a need for a portable apparatus to enable an invalid to be quickly and easily moved from wheel chair to any bed or chair and back that can be transported in a car interior or trunk, or stored in a small space, thus making travel, camping and other activities possible for the severely handicapped. There are hydraulic patient lifts available, some described as being portable and capable of being folded for transport but which weight forty-six pounds. Therefore the heavy weight and awkwardness renders the present portable devices very difficult to use. Both portable and standard type hydraulic patient lifts and other similar hoists are subject to disadvantages, such as: (1) they are incapable of being broken down into small, lightweight sections or components that can be transported easily in a car trunk or interior and therefore, for all practicable use, provide for transferring an invalid from wheel chair to bed or chair and back at only one location, which is very inconvenient; (2) they must have their base placed around or under a chair or under a bed to function and therefore wil not do so with beds and wide chairs having a solid structure with no open space underneath; (3) they often can not be used at outdoor and other locations where no hard surface exists; (4) they are expensive and have to be repaired and serviced generally only at manufacturer authorized dealer shops; (5) they are heavy and can not be handled easily by women or men of small stature in the process of breaking down, transporting and storing; (6) they are extremely difficult to maneuver on carpeting because of their necessarily small casters.

SUMMARY OF THE INVENTION

The principal object of the present invention is to provide a simple, compact, lightweight, inexpensive, safe mechanical apparatus for transferring an invalid from a wheel chair to a bed, chair, or other pieces of furniture and back, and which is efficient, convenient to use, and easily handled, even by a woman of small stature, unassisted.

Another object of the present invention is to provide an invalid transfer apparatus of the character described, which can be broken down into small, lightweight components and transported in a car interior or trunk or stored in a small space. An advantageous feature of the invention is that it can be quickly and easily transported from one location to another, assembled, and readily positioned for use.

Another object of the present invention is to provide an invalid transfer device of the character described, which is safe to use under many various conditions. Previous invalid transfer devices utilising wheels or casters may be used safely only on smooth, hard, and level surfaces.

Another object of the present invention is to provide an invalid transfer device of the character described having the capability of use on almost any surface.

A further object of the present invention is to provide an invalid transfer device of the character described, having a mechanical actuating mechanism, which is extremely durable, needing little or no maintenance or repair in contrast to prior invalid lifts using hydraulic or other mechanisms.

These and other objects and advantages of the invention will become apparent to those skilled in the art from the following detailed description of the preferred embodiment thereof, with references to the accompanying drawing.

BRIEF DESCRIPTION OF THE INVENTION

The invention embraces the use of an overhead track mounted on identical tripods, one at each end. A wheeled carriage with a winch attached rides on the underside of the track. The winch is equipped with a rope tackle that hooks onto a canvas or other flexible fabric sling in which the invalid sits. The tripods have folding, telescoping legs.

The track is placed over the bed or chair in an offset position to allow space for a wheel chair between the bed or chair and the tripod furthest therefrom.

In use, the tackle is hooked onto the sling with the invalid seated therein. The winch is then activated to raise the invalid from the wheel chair. When the invalid is raised clear of the wheel chair, the wheeled carriage is moved along the track to a position over the bed or chair and the invalid is lowered by the winch thereon. The tackle is then unhooked from the sling.

The invention is used to transfer the invalid from the bed or chair to the wheel chair by reversing the procedure outlined in the above paragraph.

The invention may be then broken down using the following steps:

(1) the track is separated from the tripod furthest from the bed or chair;

(2) the wheeled carriage is removed from the track;

(3) the remaining tripod is separated from the track;

(4) the track is broken down into its separate pieces;

(5) the tripod legs are folded and telescoped to a suitable shorter length;

(6) the several components may then be transported in a car trunk or interior or stored in a small space.

The invention may be set up for use by reversing the above steps.

DESCRIPTION OF THE PREFERRED EMBODIMENT

Figure 2:
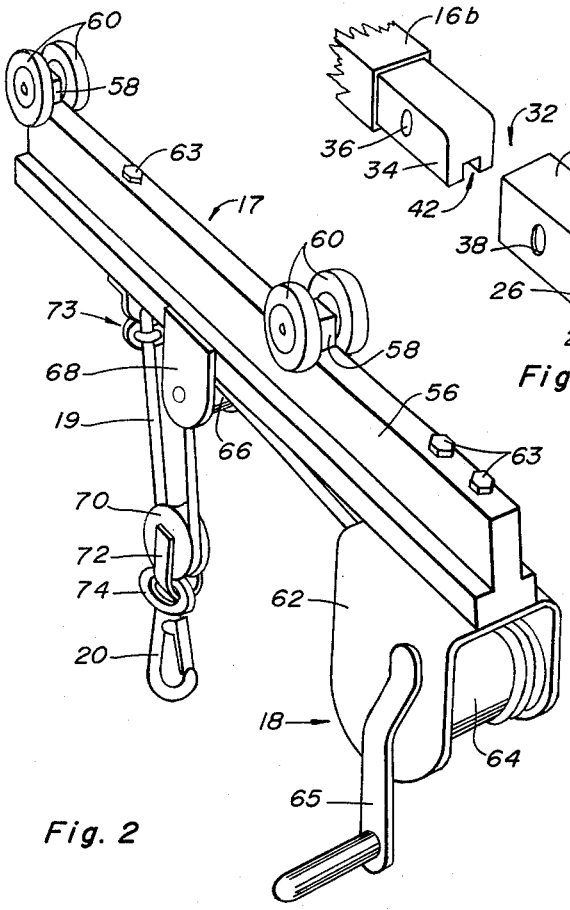
FIG. 2 is a perspective view of the wheeled carriage that rides on the underside of the overhead track.

Referring now in detail to the drawing, the reference numeral 15 designates the portable invalid lift in its entirety and comprises an overhead track 16 upon which a wheeled carriage 17 rides on the underside thereof. Mounted on the wheeled carriage 17 is a winch 18, to which a rope 19 is attached, and the latter raises and lowers a hook 20 that attaches to a canvas or other flexible fabric sling 22 with the invalid seated therein. The track 16 is supported by a tripod 80 at each end.

Figure 4:
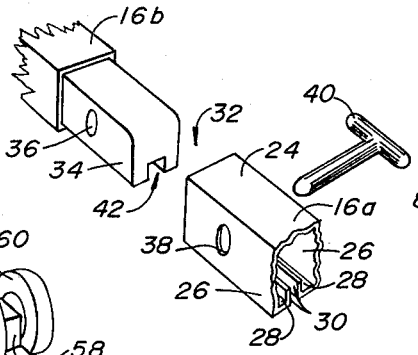
FIG. 4 is a fragmentary perspective view of the telescoping ends of the separate portions of the track showing how they are joined.
Figure 5:
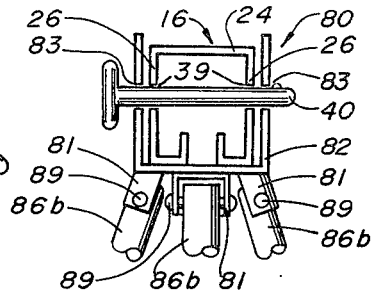
FIG. 5 is a transverse elevational view of the tripod head and track resting therein and locked thereto and also showing fragmented portions of the legs thereof.
Figure 3:
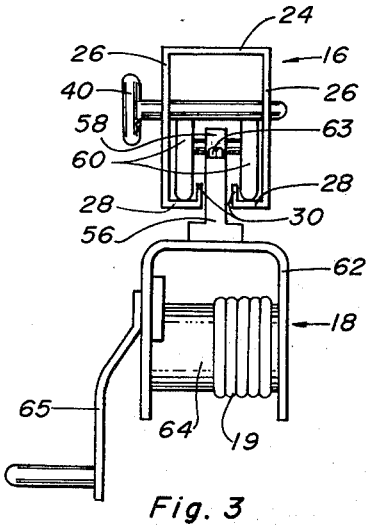
FIG. 3 is an end view of the track showing the wheeled carriage positioned on the track.

The track is preferably in the form of a straight, elongated steel beam of the cross-sectional configuration shown in FIG. 3, having a top wall 24, parallel sidewalls 26, inwardly turned track flanges 28, and upturned edges 30. The track 16 is preferably made in pieces in order to break it down into shorter lengths that can be stored in a car trunk or interior or other relatively small space, one of the pieces being a relatively long length 16*a*, and the other a relatively short length 16*b*, which are joined together at 32. FIG. 4 shows the joint 32 which is made by a solid plug 34 which is inserted into the inner end of section 16*b* and projects therefrom with the said plug 34 being solidly fixed to section 16*b*. The projecting end of plug 34 is inserted into the adjacent end of section 16*a*, and fits snugly therein. A transverse hole 36 in plug 34 registers with corresponding holes 38 in opposite sidewalls 26 of track section 16*a*, and a locking pin 40 is inserted through the aligned holes 36 and 38, to lock the two sections 16*a* and 16*b* together. Plug 34 has substantially the same outside width and height dimensions as the inside of sections 16*a* and 16*b*, less a sufficient length and no more to allow them to telescope together easily. A lengthwise-extending groove 42 in the underside of plug 34 provides clearance for the upturned edges 30 of sections 16*a* and 16*b*. Track sections 16*a* and 16*b* are of a length that will store easily in a car interior or trunk, or other relatively small space.

Figure 1:
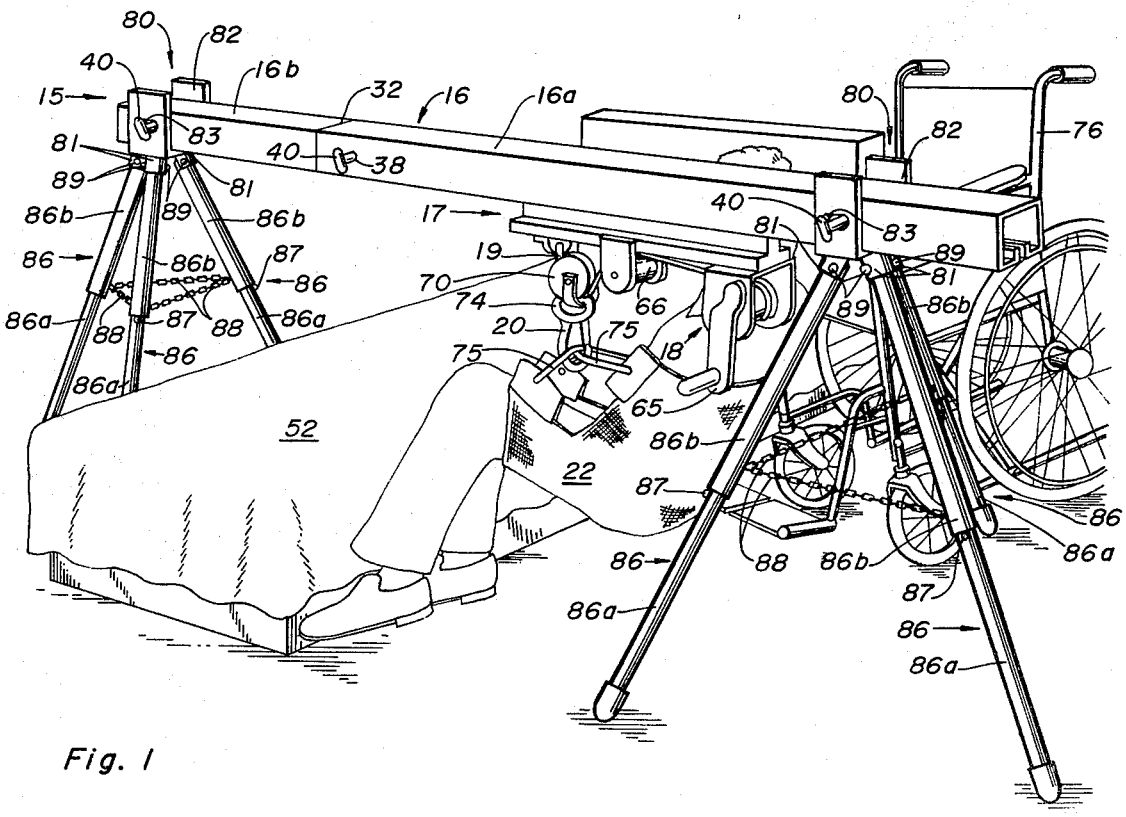
FIG. 1 is a perspective view of the device with an invalid seated in a canvas or other flexible fabric sling suspended therefrom and set up over a bed with a wheel chair nearby.

As shown in FIG. 1, the track 16 is supported by two identical tripods 80, only one of which will be described. Each leg 86 of tripod 80 is identical and only one will be described. Leg 86 is comprised of two sections, 86*a* and 86*b*, with section 86*b* being tubular and a larger diameter than tubular section 86*a* which will telescope therein. An automatic locking device 87 is mounted nearest the top of section 86*a* with said locking device 87 preferably being a spring activated inset steel ball locking mechanism. As leg section 86*a* slides out of section 86*b* to the point where the said locking device 87 is clear, the steel ball portion thereof is projected laterally and prevents section 86*b* from sliding further along section 86*a*. The tripod leg 86 is attached to bearing support 82 with a pin 89 to enable said leg 86 to move inwardly and outwardly. Said pin 89 is supported horizontally by bracket 81 attached to the underside of bearing support 82. The leg sections 86*b* are attached to each of the other two leg sections 86*b* preferably by means of a small, light-weight safety chain 88. Bearing support 82 is preferably a short section of open channel in which the outer end of track sections 16*a* and 16*b* rest. A transverse horizontal slot 83 in each sidewall portions of bearing support 82 registers with corresponding transverse hole 39 in each sidewall 26 of track sections 16*a* and 16*b* with locking pin 40 inserted through the aligned holes 83 and 39 to prevent the track 16 from separating from the bearing rests 82.

The wheeled carriage 17, which rides on track 16 is shown in detail in FIG. 2 and comprises an elongated body member 56 in the form of an inverted T-shaped bar, that is preferably machined or extruded aluminum alloy but may be formed of two aluminum alloy bars attached normal to each other by bolts 63. The vertical web of the bar 56 is of a width to pass freely between the upstanding edges 30 of the track 16 and fixed to the top edge of the web are two journal blocks 58 in which axles for two pairs of wheels 60 are held. The wheels 60 run on the track flanges 28 of the track 16 as shown in FIG. 3. The reason for the mounting of one pair of wheels 60 opposite the winch 18 attached by bolts 63 to body member 56 and the other pair of wheels 60 slightly more than halfway toward the end on which the winch 18 is mounted will become apparent hereinafter.

The rope 19 is preferably made of polyethylene fibers and extends inwardly from the drum 64 along the bottom side of the bar 56, and passes over a pulley 66 which is rotably supported between two bracket plates 68 fixed to opposite sides of the bar 56 and extending downwardly therefrom. The rope passes under a pulley 70 rotably supported between the arms of a U-shaped strap 72, and back up to an anchorage attachment 73 attached to the bar 56 by bolt 63 to the underside of said bar 56. Hook 20 is connected to said U-shaped strap 72 by a ring 74. Said hook 20 is adapted to catch securely onto loops 75 attached to opposite sides of the fabric sling 22 in which the invalid sits, and when said hook 20 is raised by the winch 18, said sling 22, and the invalid sitting in it, are raised from the bed 52 or wheel chair 76, depending upon the particular origin of movement.

The operation of the portable invalid lift 15 is as follows: First it must be assumed that the invalid is seated in the wheel chair 76, with the fabric sling 22 placed under the buttocks, thighs, and upwards along the back to provide added stability and support. The two tripods 80 are set up with their legs 86 spread to the limits allowed by the safety chains 88. One tripod 80 with the bearing support 82 is set up on the working side of the bed 52 (or chair) at some distance therefrom where the lifting will occur. The other tripod 80 with the bearing support 82 is then placed directly opposite the first tripod 80 with said bearing support 82 on the idle side of the bed 52 (or chair). The two track sections 16*a* and 16*b* are joined together at 32 and secured by inserting pin 40 through aligned holes 36 and 38, and the wheeled carriage 17 is then inserted into track section 16*a* and moved to a position clear of the outward end thereof. Said outward end of track section 16*a* is then dropped into bearing support 82 and the outward end of track section 16*b* is then raised to a position slightly above the opposite bearing support 82 and dropped therein. The wheel chair 76 is maneuvered to place it directly under hook 20. The winch handle 65 is then cranked in the direction to position said hook 20 so as to engage the loops 75 on the fabric sling 22. The winch handle 65 is then cranked in a direction to raise the invalid clear of the wheel chair 76. The wheeled carriage 17 is then moved inwardly along the track 16 to the desired position above the bed 52. The winch 18 is then operated to lower the invalid to the bed 52, where said hook 20 is disengaged from said loops 75. Said track 16 is then removed from the tripods 80, the wheeled carriage 17 removed from the track 16*a*. Said track 16 is then broken down into the two sections 16*a* and 16*b*, and stored in a car trunk or other small space along with the wheeled carriage 17. The tripod legs 86 are then folded inwardly together and each leg section 86*a* is then telescoped into leg section 86*b*. The tripods 80 may then be stored in a car trunk or other small space. To transfer the invalid from the bed 52 to the wheel chair 76, the complete procedure is reversed.

While we have shown and described in considerable detail what we believe to be the preferred embodiment of the invention, it will be understood that numerous modifications will readily occur to those skilled in the art after consideration of the foregoing specification and accompanying drawing. It is not intended to limit the invention to the precise embodiment shown and described, but all suitable modifications and equivalents may be readily adapted within the scope of the claims that follow.

What is claimed is:

1. A portable apparatus for transferring an invalid from a wheel chair to a bed or chair, and vice versa, said apparatus comprising:

an elongated track extending transversely over said bed or chair with one end projecting laterally from one side thereof with aligned holes at both ends of said track's vertical sidewalls;

first support means a tripod with telescoping legs, connected one to another on the upper portion thereof by a safety chain, said tripod set under the outermost portion of said laterally projecting section of said track, said tripod having a short section of channel open at the top mounted horizontally on the apex thereof in which the outer end of the laterally projecting end of said track section rests, said channel having aligned holes in its vertical sidewalls to line up with said aligned holes in said outermost portion of laterally projecting section of track to receive a locking pin, each said tripod leg being in two or more nearly equal sections with the lower sections being of a smaller size than the immediate section above and telescoping therein with each lower section on its upper end having a spring activated inset hard material ball on the outer surface thereof projected laterally when pulled clear by said spring sufficiently to prevent said immediate upper leg section from sliding downward thereon when said leg sections are extended, said ball also preventing said sections from extending downward accidentally when telescoped together by being projected laterally by said spring against the inner wall of said immediate upper leg section with sufficient pressure to cause enough friction to resist the force of gravity;

second support means a tripod identical to said first support means with an identical horizontal channel mounted at the apex thereof in which the outermost portion of the non-laterally projecting section of said track rests identically to said first support means and is secured identically to said first support means by an identical locking pin inserted through identical aligned holes in said channel's vertical sidewalls and aligned holes in the vertical sidewalls of said outermost portion of said non-laterally projecting section of track;

a wheeled carriage movable along the laterally projecting section of said track;

a winch with a rope depending therefrom mounted on said movable wheeled carriage;

a sling in which an invalid person sits; and means on said rope attachable to said sling, said winch being operable to raise said invalid from said wheel chair or chair and to lower said person into said bed or chair or vice versa, said wheeled carriage being movable with said invalid between a first position on the laterally projecting portion of said track directly over said wheel chair, and a second position over said bed or chair.

* * * * *